US006526604B1

(12) United States Patent
Mathis

(10) Patent No.: US 6,526,604 B1
(45) Date of Patent: Mar. 4, 2003

(54) POOL COVER TRACKING SYSTEM

(75) Inventor: Wesley L. Mathis, West Jordan, UT (US)

(73) Assignee: Pool Cover Specialists National, Inc., West Jordan, UT (US)

( * ) Notice: Subject to any disclaimer, the term of this patent is extended or adjusted under 35 U.S.C. 154(b) by 0 days.

(21) Appl. No.: 09/726,243

(22) Filed: Nov. 29, 2000

Related U.S. Application Data

(60) Provisional application No. 60/168,171, filed on Nov. 30, 1999.

(51) Int. Cl.[7] ..... E04H 4/10
(52) U.S. Cl. ..... 4/502; 16/96 R
(58) Field of Search ..... 4/502; 160/271, 160/272, 273.1; 16/96 R

(56) References Cited

U.S. PATENT DOCUMENTS

| | | | | |
|---|---|---|---|---|
| 2,815,809 A | | 12/1957 | Jacobs et al. | 4/502 |
| 3,050,743 A | * | 8/1962 | Lamb | 4/502 |
| 3,277,498 A | | 10/1966 | Kleinbard et al. | 4/502 X |
| 3,979,782 A | | 9/1976 | Lamb | 4/502 |
| 4,464,801 A | | 8/1984 | Lamb | 4/502 |
| 4,466,144 A | | 8/1984 | Lamb | 4/503 |
| 4,939,798 A | | 7/1990 | Last | 4/502 |
| 5,845,343 A | | 12/1998 | Last | 4/502 |
| 5,920,922 A | | 7/1999 | Ragsdale et al. | 4/502 |
| 5,950,253 A | | 9/1999 | Last | 4/502 |

* cited by examiner

*Primary Examiner*—Robert M. Fetsuga
(74) *Attorney, Agent, or Firm*—Clayton, Howarth & Cannon, P.C.

(57) ABSTRACT

A track assembly for flexible pool covers. The track assembly includes several track members, and splicing pieces for splicing the track members together in an end-to-end series. The splicing pieces are designed to reside beneath, and to be concealed by, the tracking members. The splicing pieces are attached to a pool deck with screws, after which the track members are snapped down onto the splicing pieces and held in place by said splicing pieces. The track members conceal the splicing pieces and the screws that hold the splicing pieces to the pool deck, thereby providing an aesthetic appearance of continuous tracking uninterrupted by screw holes. Such an arrangement also prevents the screws from coming loose and posing a risk to barefooted bathers, in part because at least some upward movement of the screws is prevented by the track pieces that reside directly above the screws.

2 Claims, 1 Drawing Sheet

POOL COVER TRACKING SYSTEM

CROSS-REFERENCE TO RELATED APPLICATIONS

This application claims the benefit of U.S. Provisional Application No. 60/168,171, filed Nov. 30, 1999.

STATEMENT REGARDING FEDERALLY SPONSORED RESEARCH OR DEVELOPMENT

Not Applicable.

BACKGROUND OF THE INVENTION

1. The Field of the Invention

The present invention relates generally to a track assembly for guiding the placement and removal of flexible enclosure covers, and more particularly, but not entirely, to a pool cover tracking system.

2. Description of Related Art

It is known to provide a retractable pool cover, such as flexible pool cover 32 shown in FIG. 1. The leading edge 62 of the flexible pool cover 32 is guided along parallel tracks, shown schematically in FIG. 1 as items 40. The tracking 40 of the prior art is typically secured directly to the pool deck with screws 42. Some of the disadvantages include the unappealing appearance of screws 42 that disrupt the uniformity and aesthetic appearance of the tracking 40. Further, the tracking screws 42 can come loose and protrude upwardly, posing a danger to barefooted bathers near the pool who might strike their toe or foot against the loose screw, possibly cutting their toe or foot on the loose screw.

The prior art is thus characterized by disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a track assembly for guiding the placement and removal of a flexible pool cover.

It is another object of the present invention to provide such a track assembly that is safer and less likely to cause injury.

It is a further object of the present invention, in accordance with one aspect thereof, to provide such a track assembly that is more securely attachable to a pool deck.

It is an additional object of the invention, in accordance with one aspect thereof, to provide such a track assembly that requires less maintenance.

It is another object of the present invention to provide such a track assembly that is more aesthetically pleasing.

The above objects and others not specifically recited are realized in a specific illustrative embodiment of a track assembly for flexible pool covers. The track assembly includes several track members, and splicing pieces for splicing the track members together in an end-to-end series. The splicing pieces are designed to reside beneath, and to be concealed by, the tracking members. The splicing pieces are attached to a pool deck with screws, after which the track members are snapped down onto the splicing pieces and held in place by said splicing pieces. The track members conceal the splicing pieces and the screws that hold the splicing pieces to the pool deck, thereby providing an aesthetic appearance of continuous tracking uninterrupted by screw holes. Such an arrangement also prevents the screws from coming loose and posing a risk to barefooted bathers, in part because at least some upward movement of the screws is prevented by the track pieces that reside directly above the screws.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
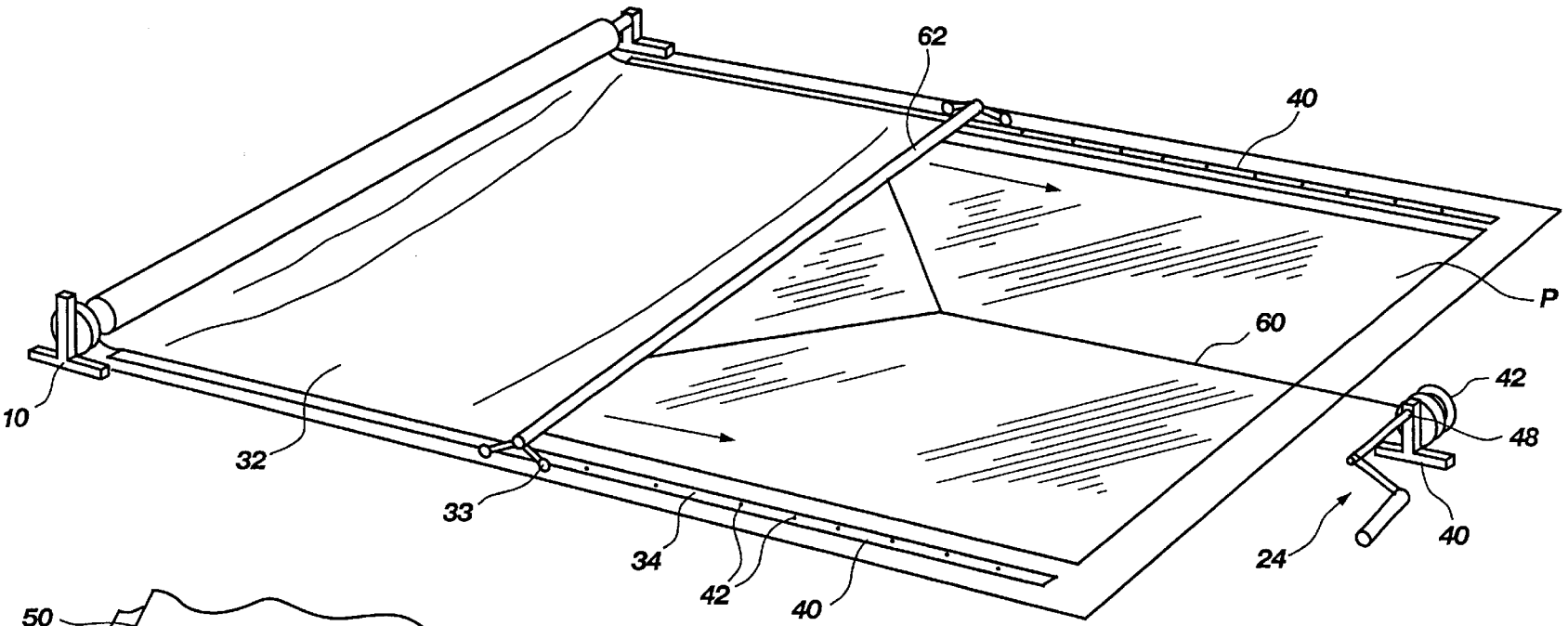
FIG. 1 (PRIOR ART)
FIG. 1 is a schematic view of a prior art flexible pool cover with tracking secured to the pool deck by screws.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant has discovered that pool cover tracking can be designed to conceal the attachment screws, thereby producing a more continuous appearance uninterrupted by screws and screw holes. Applicant's design also reduces that likelihood of screws coming loose, a disadvantage of the prior art that weakens the attachment of the tracking to the pool deck and poses a risk to barefooted bathers who might strike their foot or toe on a loose screw.

Figure 2:
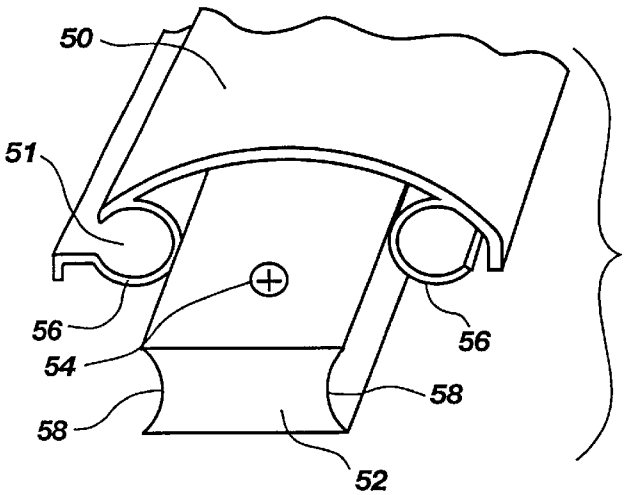
FIG. 2 is a partial, break-away view of a pool cover tracking assembly, made in accordance with the principles of the present invention.

Referring now to FIG. 2, there is shown a break-away view of applicant's tracking design, in the form of tracking 50 and attachment splice 52. The tracking 50 includes a channel 51 for receiving a movement piece of a flexible pool cover, such as movement piece 33 shown in FIG. 1, in sliding contact therein. The attachment splice 52, sometimes referred to herein as a means for splicing, is secured directly to the pool deck with screws 54, said screws 54 are sometimes referred to herein as attachment means. The tracking 50 is then snapped downwardly upon the attachment splice 52, such that grip arms 56 of the tracking 50 extend into recesses 58 along the sides of the attachment splice 52, thus causing the tracking 50 to be held firmly against the pool deck. The tracking 50 conceals the screws 54, thus providing for a more continuous, aesthetic appearance and also preventing any loose screws from being exposed to pose a danger to swimmers. Tracking 50 further comprises a top surface for covering the attachment splice 52 thereby providing a continuous surface, and an under surface opposite the top surface.

The grip arms 56 are preferably of a partially cylindrical shape, and the channel 51 is preferably defined by a partially cylindrical boundary. The recesses 58 are preferably defined by a partially cylindrical boundary as well. It is to be understood that the terms "cylinder" or "cylindrical" as used herein shall be broader in meaning than the phrase "circular cylinder," the latter being limited in meaning to a cylindrical shape being circular in cross section. A cylindrical shape for purposes of this application therefore refers broadly to any three-dimensional elongate shape having an at least partially rounded cross section.

Aspects of the present invention may also be described as set forth below.

Description of Invention:

A means of securing surface-mounted, automatic-pool-cover track ("toptrack") in a manner that eliminates the visibility of the anchoring screws holding the track to the deck, thus permitting the track to have a more aesthetically-pleasing appearance and eliminating the possibility that the track screws could become loose and pose a danger to bathers walking on the pool deck.

Details:

1. ¼" holes, spaced approximately two feet apart, are drilled into the pool deck on each side of the pool, along a chalked line corresponding to the eventual positioning of surface-mounted, poolcover track. Plastic anchors are then inserted into the drilled holes.
2. Two-inch-long, aluminum, anchoring-extrusions with a single hole drilled through the center are then placed above each of the holes drilled into the pool deck. A stainless-steel, anchoring screw is inserted into each hole and threaded through the plastic deck-anchor (previously pressed into the ¼" deck holes and tapped flush with the deck). The screws are tightened, fastening the anchoring-extrusions to the deck, such that the extrusions run lengthwise to the chalked line.
3. The track sections are placed along the chalked line, above the in-line, anchoring-extrusions. Note: The extrusions are shaped to permit the track to "snap" down over the top of the anchoring-extrusions when the top of the track, positioned directly above the anchoring extrusion, is tapped lightly with a rubber mallet, fixing the track to the pool deck.
4. The inside edge of each two-inch, anchoring-extrusion is machined precisely to allow the track to snap into place over the anchoring-extrusion. Additionally, once the automatic pool cover has been installed and the cover fabric inserted into the fabric-channel of the track, the aluminum, anchoring-extrusion is designed such that more weight that is applied to the surface of the pool cover (i.e., standing water, snow, ice, people walking onto the cover, etc.), the tighter the track is held to the deck.
5. In the event that the track needs to be removed for maintenance to the pool deck or to replace or repair the pool cover fabric, the track can be "pried" loose by inserting a pry-bar to the outside edge of the track.

Advantages/Improvements to Existing Technology:

Existing technology (prior art) requires surface-mounted, pool-cover track to be anchored to the pool deck by means of track screws inserted through pre-drilled holes in the top of the track and into pre-installed concrete anchors which have been tapped flush with the deck. Because the surface-mounted track is curved on top and of minimal thickness, it is impossible to countersink the anchoring holes enough to permit the tops of the track screws to be flush with the track. The screw head, traditionally, sits slightly above the top of the track, creating a hazard to bathers walking on the deck. In addition, over time, factors like ground settling, deck temperature (which causes the track to expand or contract slightly), and motion of the cover moving back and forth tend to cause the track screws to become loosened and, thus, subject to periodic tightening, a maintenance-intensive task. Because the new technology permits the track to be "snapped" over the top of the anchoring-extrusions, covering the screws which fasten the track-extrusions to the deck, the risk of stubbing a toe or incurring a laceration is eliminated completely, and since the two-inch track-extrusions are less susceptible to being affected by deck shifting, temperature variations, or motion of the cover (and also "trap" the anchoring-extrusion screws in place), the track remains tightly secured to the deck, reducing track maintenance considerably and eliminating the possibility of laceration to a bather's foot in the event that the bather steps on the track.

The new technology in accordance with the principles of present invention also creates a much more aesthetically-pleasing, "finished" look since throughout the entire length of the track extrusion, there are no visible screws. During installations using existing technology, invariably, during the track-anchoring process, sharp edges and "burrs" are created when the screwdriver or driver bit is used to tighten the screws. To avoid injury to individuals who may step on the track, these burrs have to be filed individually. The new technology eliminates this installation procedure.

In the event that the track needs to be removed, either to repair the pool deck or repair/replace the pool cover fabric, existing technology requires the technician to remove every track-anchoring screw (spaced every two feet down each track length), a time-consuming process. The new technology permits the track to be "pried" loose from the outside edge, a process that allows the track to be removed much more quickly than is possible utilizing existing technology.

It will be appreciated that the structure and apparatus disclosed herein to illustrate a tracking means, such as the tracking 50, is merely one example of a tracking means for guiding movement pieces of a flexible pool cover, and it should be appreciated that any structure, apparatus or system for guiding movement pieces that functions the same as, or equivalent to, those disclosed herein are intended to fall within the scope of a tracking means for guiding movement pieces, including those structures, apparatus or systems for guiding which are presently known, or which may become available in the future. Anything which functions the same as, or equivalently to, a tracking means for guiding movement pieces of a flexible pool cover falls within the scope of this element.

It will be appreciated that the structure and apparatus disclosed herein to illustrate a splicing means, such as attachment splice 52, is merely one example of a splicing means for splicing the track members together in an end-to-end series, and it should be appreciated that any structure, apparatus or system for splicing that functions the same as, or equivalent to, those disclosed herein are intended to fall within the scope of a means for splicing, including those structures, apparatus or systems for splicing which are presently known, or which may become available in the future. Anything which functions the same as, or equivalently to, a means for splicing falls within the scope of this element.

In accordance with the features and combinations described above, a preferred method of providing a tracking guide for guiding movement pieces of a flexible pool cover includes the steps of:

(a) attaching splicing pieces to a pool deck; and (b) attaching a tracking means for guiding movement pieces of the flexible pool cover to the splicing pieces such that said tracking means resides above, and conceals, the splicing pieces.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail in connection with what is resently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A track assembly for guiding the placement and removal of a flexible pool cover, said track assembly comprising:

tracking means for guiding movement pieces of a flexible pool cover, said tracking means further comprising a plurality of track members;

splicing means for splicing the track members together in an end-to-end series; and attachment means for attaching the splicing means to a pool deck;

wherein each track member includes an under surface, and a first elongate grip arm formed below said under surface and a second elongate grip arm formed below said under surface, and wherein the first and second grip arms are configured and dimensioned to grip the splicing means therebetween;

wherein the splicing means comprises a plurality of elongate splice pieces, each splice piece having a top, a bottom, a first side and a second side, and a first elongate recess formed in the first side and a second elongate recess formed in the second side, said first and second recesses being configured and dimensioned for receiving the first and second grip arms thereinto.

2. The track assembly of claim 1, wherein the grip arms are partially cylindrical in shape, and wherein the first and second elongate recesses are defined by a partially cylindrical boundary.

* * * * *

UNITED STATES PATENT AND TRADEMARK OFFICE
Certificate

Patent No. 6,526,604 B1 Patented: March 4, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Wesley L. Mathis, West Jordan, UT (US); David B. Dalton, Heber City, UT (US); and Matthew D. Greeff, Herriman, UT (US).

Signed and Sealed this Twentieth Day of June 2006.

JUSTINE R. YU
*Supervisory Patent Examiner*
Art Unit 3751